United States Patent [19]

Sather et al.

[11] Patent Number: 4,984,360

[45] Date of Patent: Jan. 15, 1991

[54] METHOD OF FABRICATING FLAKER EVAPORATORS BY SIMULTANEOUSLY DEFORMING WHILE COILING TUBE

[75] Inventors: Keith O. Sather, Albert Lea, Minn.; Edward R. Gade, Mundelein, Ill.; David A. Tandeski; Lawrence E. Olson, both of Albert Lea, Minn.

[73] Assignee: Scotsman Group, Inc., Vernon Hills, Ill.

[21] Appl. No.: 533,932

[22] Filed: Jun. 5, 1990

Related U.S. Application Data

[63] Continuation of Ser. No. 314,043, Feb. 22, 1989, abandoned.

[51] Int. Cl.[5] ..... B21D 53/06

[52] U.S. Cl. ..... 29/890.053; 29/890.037; 29/890.054; 29/890.07; 72/142

[58] Field of Search ..... 29/726, 727, 890.03, 29/890.036, 890.037, 890.053, 890.054, 890.07; 72/140, 141, 142, 143, 145; 165/164, 169, 184; 219/39

[56] References Cited

U.S. PATENT DOCUMENTS

| | | | |
|---|---|---|---|
| 1,165,779 | 12/1915 | Humphrey | 72/141 X |
| 1,525,527 | 2/1925 | Wennerstrom . | |
| 1,990,738 | 2/1935 | La Porte | 29/157.3 |
| 1,993,171 | 3/1935 | Hyde | 29/157.3 AH |
| 2,513,611 | 7/1950 | Woller | 72/141 X |
| 2,522,365 | 9/1950 | Greene . | |
| 2,691,813 | 10/1954 | Polad | 29/157.3 AH |
| 3,217,392 | 11/1965 | Roffelsen | 29/157.3 AH |
| 3,318,376 | 5/1967 | Vihl | 165/169 |
| 3,482,298 | 12/1969 | Brucken | 72/142 X |
| 3,739,842 | 6/1973 | Whalen | 165/164 |
| 3,996,779 | 12/1976 | Hawley | 72/142 |
| 4,024,620 | 5/1977 | Torcomian | 29/157.3 |
| 4,061,184 | 12/1977 | Radcliffe . | |
| 4,185,369 | 1/1980 | Darrow et al. | 29/156.8 |
| 4,328,681 | 5/1982 | Sakamota et al. . | |
| 4,379,390 | 4/1983 | Bottum . | |
| 4,497,184 | 2/1985 | Utter et al. . | |
| 4,576,016 | 3/1986 | Nelson . | |
| 4,589,261 | 5/1986 | Ohasi et al. . | |
| 4,739,630 | 4/1988 | Tandeski et al. . | |

*Primary Examiner*—Joseph M. Gorskl
*Assistant Examiner*—Peter Vo
*Attorney, Agent, or Firm*—Harness, Dickey & Pierce

[57] ABSTRACT

A straight axial length of round metal tube is deformed such that the tube cross-section is D-shaped and coiled into a helix, a coil mandrel and wheel mandrel simultaneously drawing and deforming the tube cross-section without kinking. The interiorly facing flat faces of the helix define a substantially continuous cylindrical surface which allows the helix to be rapidly mountable onto a cylindrical heat transfer evaporator tank of a flaker ice making assembly. To provide enhanced heat transfer capabilities the helix could be undersized to tightly grip the evaporator tank and the tube convolutions could be brazed or soldered either together or adjacent the corner portions and tank.

7 Claims, 4 Drawing Sheets

METHOD OF FABRICATING FLAKER EVAPORATORS BY SIMULTANEOUSLY DEFORMING WHILE COILING TUBE

This is a continuation of U.S. patent application Ser. No. 07/314,043, filed Feb. 22, 1989, entitled "Method and Apparatus for Fabricating Flaker Evaporators" now abandoned.

BACKGROUND AND SUMMARY OF THE INVENTION

The present invention relates generally to heat exchanger assemblies and more particularly to such heat exchanger assemblies employed as evaporator assemblies in ice making machines. The present invention also relates to a method of fabricating such heat exchanger or evaporator assemblies.

Various types of heat exchanger assemblies, including evaporator assemblies for ice making machines frequently include a wall composed of a heat transmissive material and a plurality of sections of spaced-apart elongated fluid conduits, also composed of a heat transmissive material, disposed on one side of the wall for conveying a heat transfer fluid therethrough in order to transfer heat between the heat transfer fluid in the fluid conduits and the opposite side of the wall. The heat transfer efficiency of such heat exchanger assemblies is largely dependent upon the area of contact for conductive heat transfer between the fluid conduits and the heat transmissive wall. Such heat transfer efficiency is especially important in ice making machines with evaporator assemblies having a generally cylindrical evaporator tube and a helical fluid conduit positioned on the exterior wall of the evaporator tube with axially adjacent turns of the helical fluid conduit being axially spaced apart from one another. In such ice making machines, the heat transfer efficiency of the evaporator assembly has a very significant bearing upon the quantity of ice that the ice making machine is capable of producing in a given time as well as the cost of operating the ice making machine.

In the above-mentioned prior ice making machines, as well as in other heat exchanger devices, the adjacent turns or sections of the fluid conduits are spaced apart from one another and are typically of a cross-sectional shape having generally arcuate sides. Thus the area of contact between the fluid conduit and the heat transmissive wall is typically limited to a relatively small percentage of the outer surface areas of the heat transmissive wall and the fluid conduits, thus resulting in a relatively small heat transmissive conduction or contact area therebetween. Various attempts have been made to increase the area of contact, and thus the area of the heat conductive path, between the heat transmissive wall and the fluid conduits or arcuate conduit sections.

While such previous attempts have met with varying degrees of success, they have either not been fully effective in maintaining the area of contact, and thus the heat conductive path, between the fluid conduit and the heat transmissive wall, or they have done so only by resorting to inordinately complex structures that are difficult and relatively expensive to manufacture and install.

An object of the present invention is to improve the area of contact, and thus the heat conductive path, between a fluid conduit or conduit sections at a heat transmissive wall in an evaporator assembly or other heat exchanger device.

A further object of the present invention is to provide such an improved heat exchanger or evaporator assembly that is relatively simple and inexpensive to manufacture and install, and that thus provides an optimized relationship between efficient heat transfer, simplicity, and economy.

A further object of the present invention is provision of an apparatus whereby a straight section of copper tubing of circular cross-section may efficiently be formed into a cross-section having a D-shaped configuration with the flat of the "D" advantageously providing for enhanced surface contact with the outside transmissive surface of the evaporator cylinder.

In accordance with the present invention, an improved heat exchanger assembly has a cylindrical wall composed of a heat transmissive material and a fluid conduit, also composed of a heat transmissive material, coiled about the exterior surface of the wall for conveying a heat transfer fluid therethrough. The fluid conduit forms a continuously extending cylindrical annulus with the space between adjacent pairs of the coiled fluid conduit sections being held to a minimum because of the "D" shape, with the flat of the "D" enhancing heat transfer between the heat transmissive materials.

In accordance with this invention, the linear fluid conduit is formed on a specially configured apparatus into a cylindrical helix with the tube so coiled having a D-shaped cross-section, which helix is then inserted about the outside of the heat exchanger cylinder and the flattened wall of the deformed tube engaging flush with the exchanger. The apparatus for making the tube comprises a cylindrical coil mandrel upon which the tube is simultaneously coiled and axially spaced and a coil wheel assembly comprising a vertically adjustable support frame having a pair of upstanding arms between which a coil wheel is rotatably supported. The cylindrical surface of the coil mandrel is for flattening one side of the tube and the outer periphery of the wheel is configured with a semi-circular groove for engaging the other side of the tube cross-section.

In the formation of the helix, the tube is axially inserted into a narrowed throat formed between the coil mandrel and the coil wheel causing the tube to be simultaneously deformed into a D-shaped cross-section and wrapped into a helix about the coil mandrel. The inner diameter of the helix formed by the flat walls of the "D" is slightly less than the diameter defining the exterior surface of the heat transmissive wall whereby to grippingly position the helix thereon for final assembly and possible soldering.

A tubular helix formed in accordance with the method and apparatus herein advantageously allows large diameter tubing to be formed with rounded corner portions so as not to kink, such result reducing refrigerant flow and possibly providing less than a flat surface for optimum heat transfer. Further, the helix and deformed shape are formed simultaneously.

Other advantages and features of the present invention will become apparent from the following detailed description taken in conjunction with the accompanying drawings.

BRIEF DESCRIPTION OF THE DRAWINGS

FIG. 4 is a side elevation view, partially broken away, of a coil forming apparatus in accordance with the present invention.

FIG. 6 shows a lathe for driving the coil mandrel of FIG. 2.

DETAILED DESCRIPTION OF THE PREFERRED EMBODIMENT

Figure 1:
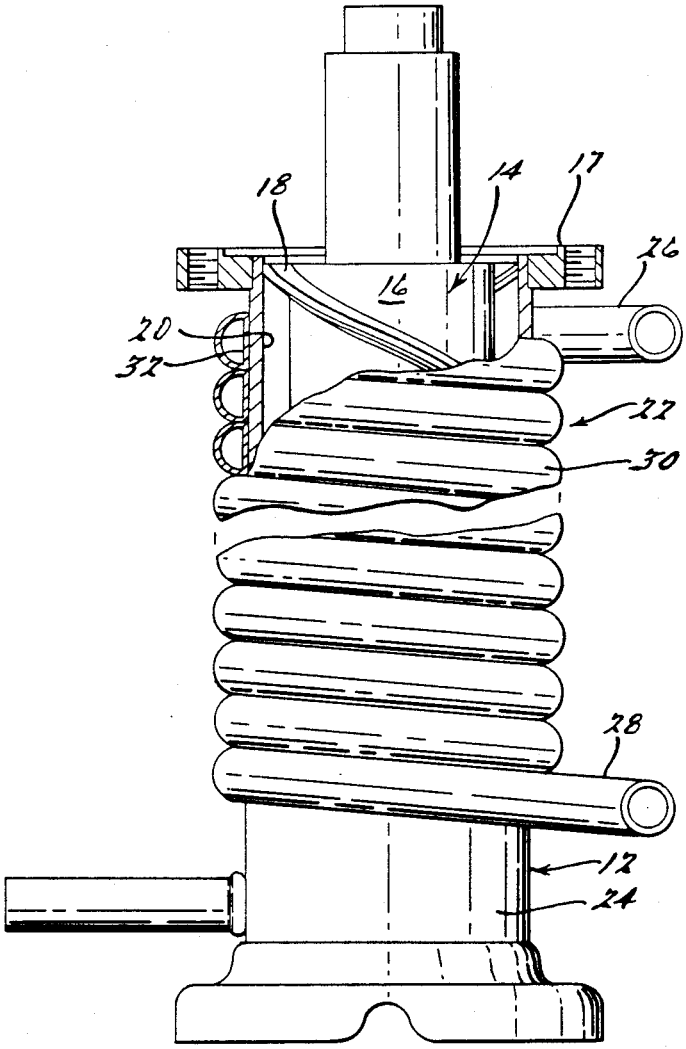
FIG. 1 is a partial elevation view, having portions removed, of a typical ice making apparatus including an evaporator assembly having a helical coil formed according to the present invention.
Figure 2:
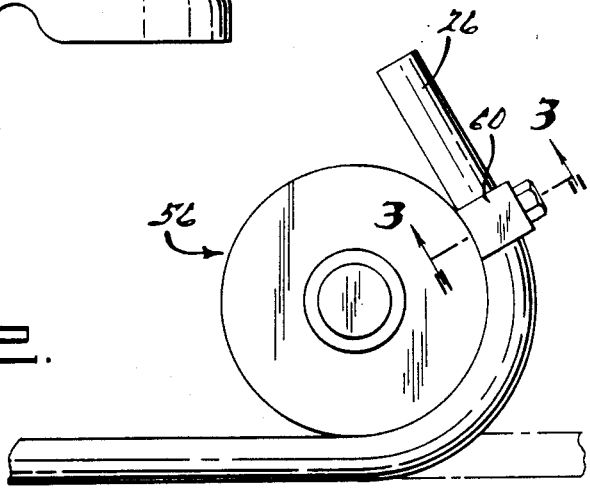
FIG. 2 is a side view of a coil mandrel securing the end of a tube length preparatory to the tube being deformed into a D-shaped cross-section and helical annulus.
Figure 3:
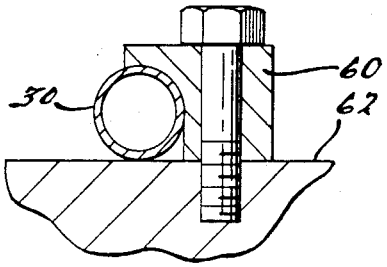
FIG. 3 is a view taken along line 3—3 of FIG. 2 showing detail of the tube securement.
Figure 1:
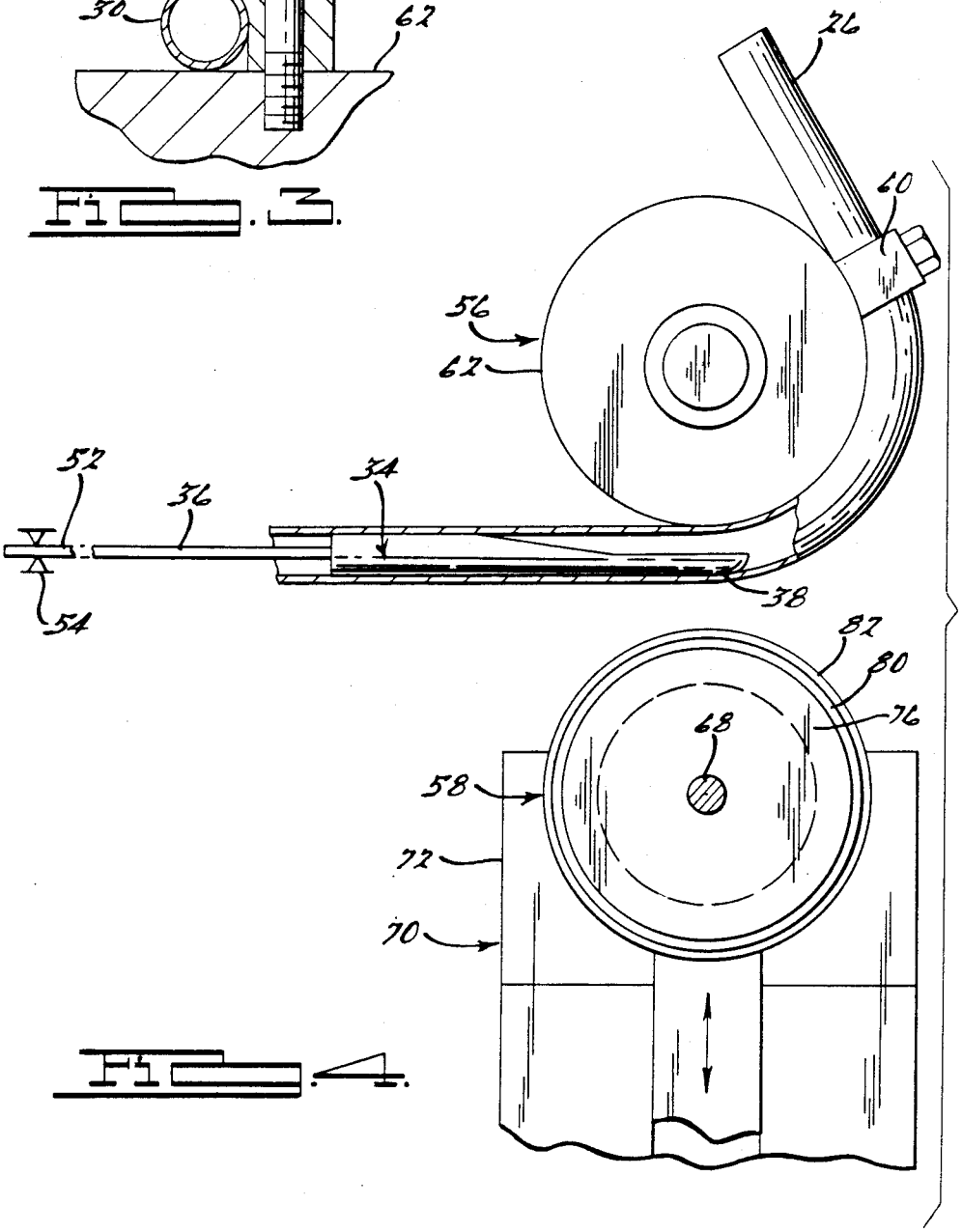

FIG. 1 illustrates an embodiment of the present invention as applied to an evaporator assembly for an ice making machine. One skilled in the art will readily recognize, however, that the principles of the present invention apply equally to evaporator assemblies for ice making machines other than that shown for purposes of illustration in the drawings, as well as to other heat exchanger assemblies in general.

FIG. 1 illustrates an auger-type ice making machine having an elongated hollow, cylindrical or tubular evaporator 12, sometimes referred to as a "worm" tube, with an elongated rotatable auger 14 disposed therein. Disposed adjacent the upper end of the evaporator is an annular mounting flange 17 adapted to support an ice extruder and breaker member (not shown), as is well known in the art. The auger 14 includes an elongated, generally cylindrical-shaped central body section 16 that is formed with an integral helical ramp or flight portion 18 defining a helical ice shearing edge disposed closely adjacent the inner peripheral wall 20 of the evaporator tube 12.

A refrigeration coil or fluid conduit 22, which can be composed of a copper-bearing tubing for example, generally surrounds at least a substantial portion of the outer peripheral wall 24 of evaporator tube 12 and is preferably arranged in a generally helical configuration. As is well known in the art, a supply of ice made-up water is introduced into the interior of the evaporator tube through suitable water supply apparatus (not shown) in order to form a thin layer of ice continuously around the interior peripheral wall 20 of the evaporator tube. Such ice is formed through the transfer of heat from the ice made-up water through the evaporator tube and the fluid conduit into a heat transfer fluid carried within the fluid conduit, in a manner generally well known in the art. Upon rotation of auger 14 by a suitable drive motor (not shown), the thin layer of ice is scraped from the interior of the evaporator tube and transferred axially upwardly along the helical flight in order to be compacted or otherwise formed into the discreet ice particles in an upper portion of the ice making machine.

In accordance with this invention, the refrigerator coil 22 for evaporator tube 12 is continuous, annular, one-piece helix and comprised of opposite end portions 26 and 28 having circular cross-sections for connection to suitable hydraulic fittings and a plurality of spiral convolutions 30 between the ends of the tube, each convolution of which being flattened out or elongated in a direction parallel to the cylindrical outer wall of the evaporator tube. Each convolution has a flat inner surface 32 engaging flush against the outer wall 24 of the evaporator tube, thereby optimizing the surface area contact between each convolution and the tank. Further, as a result of the method by which the coil is formed, the opposite lateral edges of adjacent convolutions are brought into substantially gapless engagement with one another such that the flat inner surfaces 32 of the respective convolutions 30 define a substantially continuous cylindrical surface having a diameter slightly less than the diameter defining the outer periphery of the evaporator tube, whereby the annulus of the refrigerator coil will tightly grip about the "evaporator surface" of the evaporator tube. Preferably, each convolution is soldered or brazed into physical union with the evaporator tube to further enhance the heat exchange relationship between the two.

An axial length of metal tubing, of sufficient length to be coiled into an annulus to form the evaporator surface, is taken from conventional stock of round cross-section with the forward end portion 26 of the tube section bent rearwardly to form approximately a 45° angle to the tube axis. This end portion retains its circular cross-section and defines both an outlet for the freezer and a securement for use in holding the tube during a coiling operation of the tube on a lathe. The original tube diameter, thickness, and material of the tubing to be used, as well as the size and spacing of the helix will be governed by the nature of the refrigerating or other system for which the particular evaporator is designed.

Figure 8:
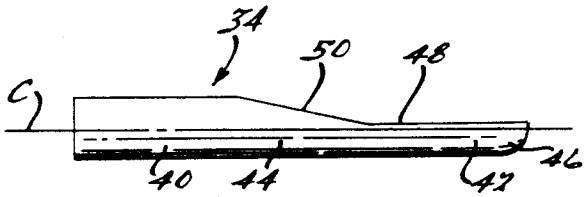
FIGS. 7 and 8 show side elevation and perspective views, respectively, of the bullet mandrel according to one aspect of the present invention.
Figure 7:
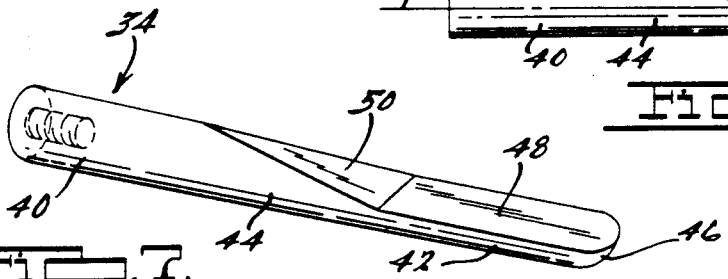
Figure 8:
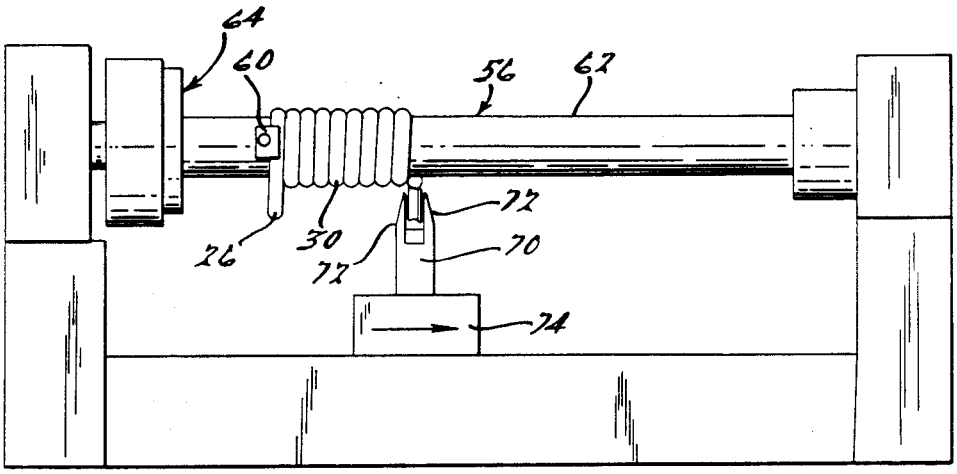

A bullet mandrel 34 at the forward end of an elongated shaft 36 is axially inserted into the undeformed end of the tube a distance sufficient that the forward end 38 of the bullet mandrel is adjacent the 45° angle bend portion of the tube. Shown best in FIGS. 7 and 8, the bullet mandrel is axially extending, generally cylindrical in cross-section and includes a rearward end portion 40 which is fixedly secured to the shaft, a flatted forward end 42 portion used in deforming the tube, and a flatted medial portion 44 forming a tapered transition between the end portions and used in initiating the deformation of the tube. The forward end portion 42 terminates in a rounded nose 46 and comprises a body having a hemicylindrical surface and a flat surface 48, respectively, for engaging one and the other side of the inner wall of the tube, the flat surface generally defining a horizontal flat plane above and parallel to the central axis "C" of the bullet mandrel. The medial portion includes a tapered flat portion 50 at an acute angle to the axis "C" to allow progressive collapse of the tube wall. The opposite end 52 of the shaft is locked at 54 to a carriage to prevent axial movement of the bullet mandrel 34 as the tube is drawn axially relative to the bullet mandrel and forwardly of the nose 46.

The tubing so prepared is positioned adjacent to a coil mandrel 56 and a wheel mandrel 58 such that the bent leading end portion 26 of the tube is received in a clamping block 60 and secured to the coil mandrel, the coil and wheel mandrels being die members which cooperate to progressively deform the wall of the tube. The coil mandrel 56 has a cylindrical outer periphery 62 and is fixedly mounted for rotation about a center axis on a turning lathe 64. The coil mandrel outer periphery is advantageously used as a backing roller for flattening and keeping the flatted surface 32 of the tube 30 perfectly flat. The clamping block 60 is intended only to secure the tube but not deform the cross-section of the tube. The undeformed portion of tube 30 extends generally along a tangent to surface 62.

The wheel mandrel 58 comprises a generally circular wheel that includes an outer periphery which is provided with a continuous 360° extending concave inward groove 66. The wheel is mounted for rotation about a central pin 68 a support frame 70 with the axis of rotation of the wheel being parallel to and in a common vertical plane including the axis of rotation of the coil mandrel. The support frame includes a pair of upstanding arms 72 between which pin 68 for rotatably supporting the wheel extends. The support frame is mounted to a carriage 74 for axial incremental movement along the axis of the coil mandrel 56 and vertically relative to the cylindrical surface 62 of the coil mandrel.

Figure 12:
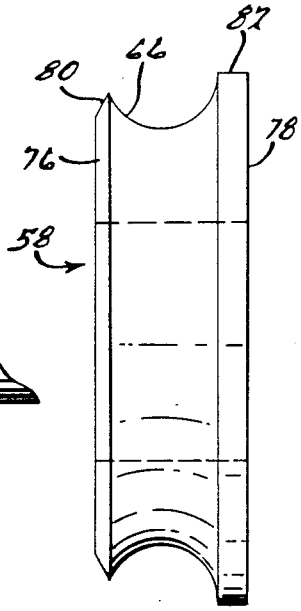
FIG. 12 is an enlarged side view of a tube engaging wheel suitably configured with a D-shaped cross-section for deforming the tube cross-section.

The cross-section of wheel mandrel is shown best in FIG. 12. The wheel includes opposite end faces 76 and 78, a beveled surface 80, and an annular rim 82, the beveled surface with the shaped groove 66 forming a V-shaped edge for guiding the deformed convolutions as they are spirally formed about the coil mandrel. The rim 82 is slightly greater in diameter than the diameter defining the edge and is adapted to be positioned adjacent the cylindrical surface 62 of the coil mandrel. The groove 66 is generally semi-circular and defined by a radius chosen such that the width of the groove is greater than the diameter of the tube 30 to be deformed, and the separation between cylindrical surface 62 and the lowest point of groove 66 being dimensioned so as to be less than the diameter of the tube. This region defines a throat through which the tube is drawn and successive tube cross-section deformed into a D-shaped cross-section. Generally, the separation between the periphery of rim 82 and cylindrical surface 62 of the coil mandrel is substantially defined by the wall thickness of the tube.

In operation, support frame 70 is slidably mounted to lathe 64 so as to be capable of incrementally advancing the wheel mandrel in a direction transverse to that of the tube axis and parallel to the coil mandrel, such movement being to allow the tubing to form a continuous helix about the coil mandrel. An adjustment member (not shown) causes the support frame 70 to be driven vertically upward whereby the annular rim 82 is positioned closely adjacent the cylindrical surface 62 of the coil mandrel. The wheel mandrel is moved axially upward and the groove 66 brought into engagement with one side of the tubing wall and, the other side of the tubing wall driven against surface 62 simultaneously as the lathe initiates rotation of the coil mandrel.

Figure 5:
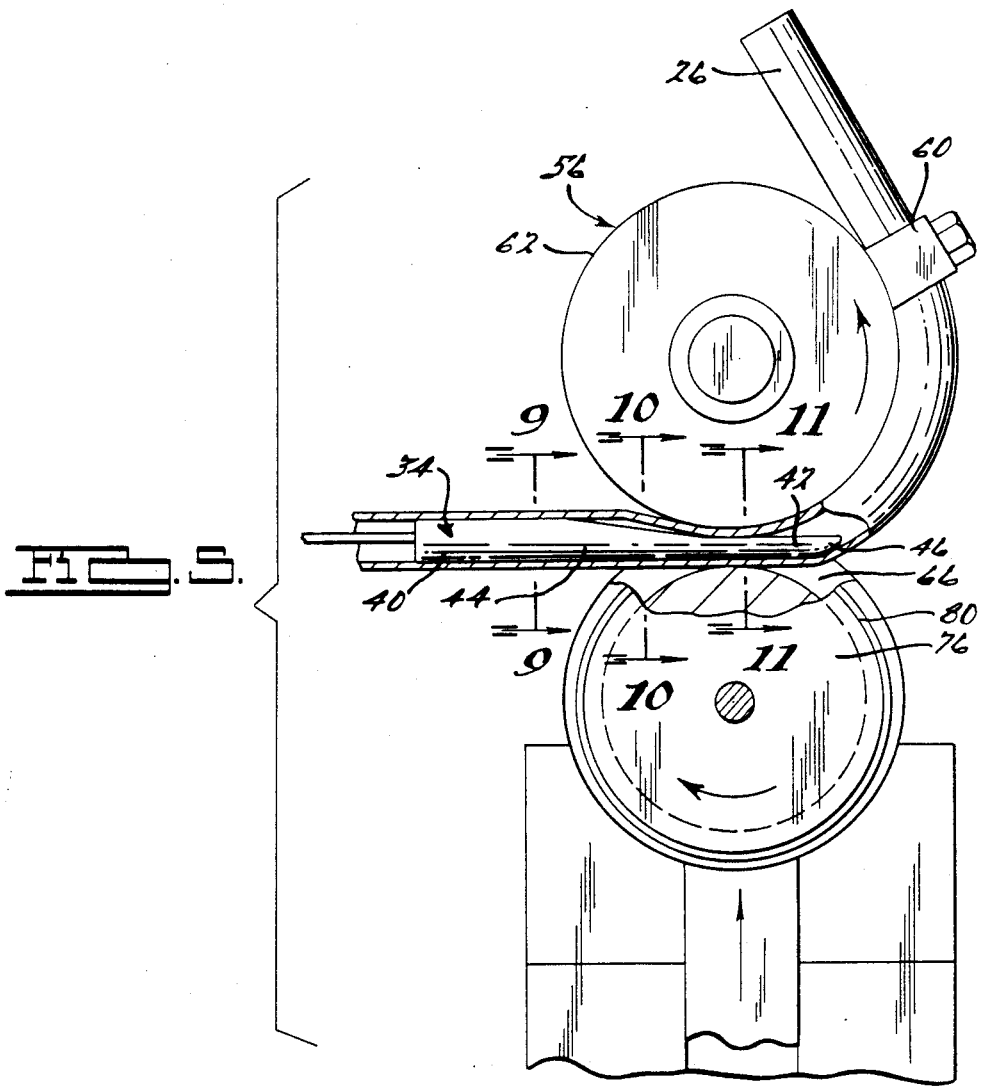
FIG. 5 is a side elevation view of the apparatus shown in FIG. 4 showing progressive deformation of the tube.

As shown best in FIG. 5, in the next step in the method of construction, the tube is axially drawn into the throat by the coil mandrel rotation and compressively deformed in the throat defined between the two die members comprising the coil mandrel and wheel mandrel whereby to reform the tubing from one having a circular cross-section into one having a D-shaped section and coiled into a helix. When the tubing is drawn through the throat defined by the D-shaped recess and cylindrical surface of the coil mandrel, the tubing will be deformed first by the cylindrical surface flattening the wall 32 of one side of the tubing. As the coil mandrel draws the deformed section away from the throat, the tube is wrapped into an annular helix about the coil mandrel with the flattened surface 32 engaging the coil mandrel.

Figure 9:
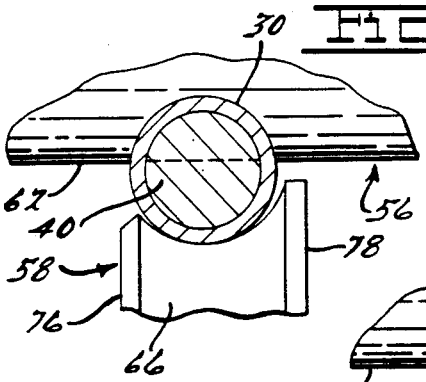
FIGS. 9, 10 and 11, respectively, are generally taken along lines 9—9, 10—10 and 11—11 of FIG. 5 to illustrate the circular cross-section of the tube being progressively deformed into a D-shaped cross-section.
Figure 10:
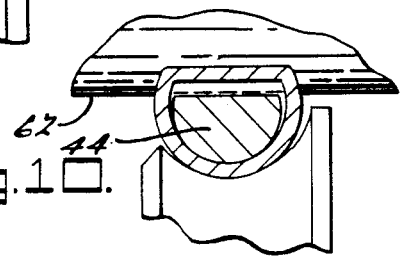
Figure 11:
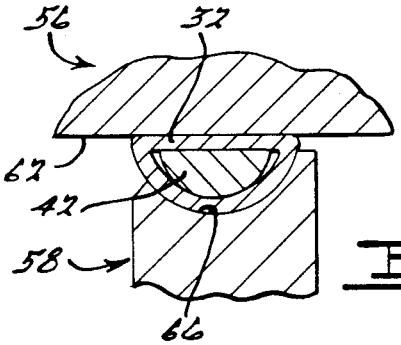

FIGS. 9, 10 and 11 show the progressive deformation of the tubing. FIG. 9 shows the clearance fit of the tube 30 about bullet mandrel 40. FIG. 10 shows the tube cross-section at a location closer to the throat between the wheel and coil mandrels and the initiation of tube wall collapse in the tapered transition section 44 of the bullet mandrel. FIG. 11 shows the completed deformation wherein the tube has a D-shaped cross-section including a flat side disposed opposite to a semi-circular portion with arcuate corner portions therebetween. Deformation of the tube wall is achieved because the transition 50 and semi-circular groove 66 allow controlled lateral collapse of the tube side walls. Generally, the forward end of the bullet mandrel is disposed in a plane spaced axially forward of the plane through the throat whereby the nose 46 assists in maintaining kink free corner portions opposite flat 32. It is to be understood that for small diameter and thin-walled tubing that the bullet mandrel may not be necessary.

In one embodiment groove 66 was defined by a radius of about 0.375 inches whereby to define a tube receiving throat of 0.750 inches, the outer diameter of tube 30 was about 0.625 inches, and a bullet mandrel 34 was cylindrical, fit into tube 30 and had an outer diameter of about 0.538 inches. The forward end 42 of bullet mandrel was bullet shaped with the leading edge of the flat being defined by the 0.375 inch radius of the forming recess, the forward end portion having a thickness slightly greater than half that of the bullet mandrel body and extending forwardly of the narrowed tube engaging region of the dies. Tubing of 0.375 inch diameter and less may not require a bullet mandrel.

While the above description constitutes the preferred embodiment of the invention, it will be appreciated that the invention is susceptible to modification, variation, and change without departing from the proper scope or fair meaning of the accompanying claims.

What I claim is:

1. A method of forming a heat transfer apparatus, the steps of the method comprising simultaneously advancing and deforming a straight length of metal tubing having a wall of cylindrical cross-section, inserting a tapered bullet mandrel interiorly of said tube for engagement with the interior wall of said tube during the deforming step, said deforming including permanently flattening the wall on one side of the length of said tubing against a coil mandrel, thereby forming the tubing into a substantially D-shaped cross-section conforming interiorly to said tapered bullet mandrel, and simultaneously with said flattening coiling the length of said tubing said coil mandrel in such fashion that when coiled the one permanently flattened side of the tube defines a substantially continuous cylindrical surface.

2. The method as recited in claim 1 wherein the advancing step includes securing an axial forward end portion of the length of said tubing to the coil mandrel such that the forward end portion of the tube maintains its cylindrical cross-section following the tube deforming.

3. The method as recited in claim 1 wherein said deforming step comprises drawing the tube through a narrowed throat formed between a rotatably mounted cylindrical mandrel and forming wheel, said throat having a dimension less that the tube cross-section whereby to compressively engage and deform the tube exterior.

4. A method of constructing a heat transfer apparatus, the steps of the method comprising bending an axial length of cylindrical tubing such that an end portion thereof is at an angle to the axis of said axial length of said cylindrical tubing, securing the bent end portion to one of a pair of dies, bringing a semicircular groove formed in the other of said pair of dies against one side of said cylindrical tubing and the other side of said cylindrical tubing against said one die, said groove having a dimension less than the outer diameter of said cylindrical tubing, and rotating said one die thereby drawing said cylindrical tubing through said semicircular groove and simultaneously with said rotating permanently deforming and coiling the cross-section of said cylindrical tubing around the other die thereby forming the tubing annulus conforming to said semicircular groove dimension.

5. A method of making a heat transfer apparatus, such as for use with flaker evaporator ice making machines, comprising simultaneously coiling and deforming an axial length of round metal tube about a coil mandrel into a cylindrical helix with each coiled portion of the tube permanently formed into a D-shaped cross-section said D-shaped cross-section of said each coiled portion of the tube having a flat side disposed opposite to a semi-circular portion and arcuate corner portions therebetween, the corner portions of said coiled portion abutting corner portions of adjacent coiled portion of the tube and the flat sides of said coiled portions of the tube defining a substantially continuous cylindrical wall of said cylindrical helix.

6. The method as recited in claim 5 including providing a generally hollow tubular metal evaporator tank having a generally hollow tubular metal evaporator tank having a generally cylindrical exterior diameter greater than the diameter of said cylindrical wall, and slightly radially expanding said cylindrical helix and fitting same about the evaporator tank.

7. The method as recited in claim 6 including brazing or soldering the adjacent corner portions to form a substantially continuous heat transmission path between the tube and tank.

* * * * *

UNITED STATES PATENT AND TRADEMARK OFFICE

CERTIFICATE OF CORRECTION

PATENT NO. : 4,984,360

DATED : Jan. 15, 1991

INVENTOR(S) : Keith O. Sather et al

It is certified that error appears in the above-identified patent and that said Letters Patent is hereby corrected as shown below:

Col. 6, Line 60, Claim 1
after "tubing" insert --about--;

Col. 7, Line 5, Claim 3
"that" should be --than--;

Col. 7, Line 25, Claim 4
after "tubing" insert --into an--;

Col. 8, Line 17-18, Claim 6,
delete "hollow tubular metal evaporator tank having a generally" after --generally--;

Signed and Sealed this

Eighth Day of September, 1992

*Attest:*

*Attesting Officer*

DOUGLAS B. COMER

*Acting Commissioner of Patents and Trademarks*